US005613798A

United States Patent [19]

Braverman

[11] Patent Number: 5,613,798

[45] Date of Patent: Mar. 25, 1997

[54] TRAFFIC MARKER AND BASE UNIT

[76] Inventor: Josef J. Braverman, 32 Loma Vista Drive, Thornhill, Ontario, Canada, L4J 7S3

[21] Appl. No.: 498,836

[22] Filed: Jul. 6, 1995

[51] Int. Cl.[6] ..... E01F 9/00

[52] U.S. Cl. ..... 404/6; 404/9; 404/10; 256/1; 256/13.1; 116/63 P; 116/63 C

[58] Field of Search ..... 404/6, 9, 10; 256/1, 256/13.1; 116/63 P, 63 C

[56] References Cited

U.S. PATENT DOCUMENTS 4,312,600 1/1982 Schaaf et al. ..... 404/6
5,234,280 8/1993 Cowan ..... 404/6

*Primary Examiner*—Henry A. Bennett
*Assistant Examiner*—Pamela O'Connor
*Attorney, Agent, or Firm*—R. Craig Armstrong

[57] ABSTRACT

A traffic channelizing device has a base unit made from the sidewalls of used car or other vehicle tires, using tread portions as a stabilizer between two sidewalls, wound spirally and having an outer band with a protruding loop which results in the resilient integral base unit having a significantly reduced propensity to roll when the device is overturned. The device has the advantages of being highly resistant in wind and impact, yet being readily removable and stackable with substantially less manpower and transportation space than for existing devices. If the central hole for the upper sidewall portion of the base unit is larger than that for the lower sidewall portion, the device retains the traffic safety feature of the base being separable from the body portion in the event of a high impact, even where the upper portion comprises more than one sidewall.

9 Claims, 3 Drawing Sheets

TRAFFIC MARKER AND BASE UNIT

BACKGROUND OF THE INVENTION

This invention relates to a base unit for attachment to a traffic channelizing device, using recycled vehicle tires.

Devices used for diverting or directing vehicular traffic, particularly on road construction sites, commonly comprise hollow plastic ballast-filled containers, such as a conical or cylindrical barrels with a weighting means such as sand within the barrel portion, or such containers with sandbags or other ballast means stacked inside or outside, to provide a low centre of gravity or an anchor to ensure that the device remains upright and in its desired location. The barrel portion of such devices is generally constructed of a material having a good resistance to extreme weather conditions, and a resilience so as to maintain the integrity of the devices despite frequent impacts from traffic or during handling, without creating excessive hazards to vehicles. Recent developments in such devices have included the use of the sidewall portion of used truck tires, mounted as a base to a body portion.

Existing devices suffer from the disadvantages of being cumbersome to install, remove or transport to another location. Devices using sand as ballast suffer from the further disadvantage of loss of sand in the event of breakage of the bags or plastic containers. Devices using the sidewalls of large truck tires have the advantage of recycling parts of used tires, but require a large space for the base; such space is frequently not safely available in the situations which require the use of channelizing devices. Existing devices using the sidewalls of truck tires also have the propensity to roll if knocked over, potentially creating a serious hazard to traffic. If increased stability is achieved by stacking several tire sidewalls, the safety requirement that the base be separable from the body portion in high impact is jeopardized.

SUMMARY OF THE INVENTION

It has been found that a more stable device having a smaller base can be made by using the sidewalls of smaller tires, such as car tires, and using the tread portion as a stabilizer, wound spirally between the sidewalls and having an outer band with a protruding loop which results in the resilient integral base unit having a significantly reduced propensity to roll when the device is overturned. The device has the advantages of being highly resistant to wind and impact, yet being readily removable with substantially less manpower and transportation space than for existing devices. If the central hole for the upper sidewall portion of the base unit is larger than that for the lower sidewall portion, the device retains the traffic safety feature of the base being separable from the body portion in the event of a high impact, even where the upper portion comprises more than one sidewall.

BRIEF DESCRIPTION OF THE DRAWINGS

The invention will now be described with reference to preferred embodiments by way of example, as illustrated in the accompanying drawings, in which.

DETAILED DESCRIPTION OF THE PREFERRED EMBODIMENT

Figure 1:
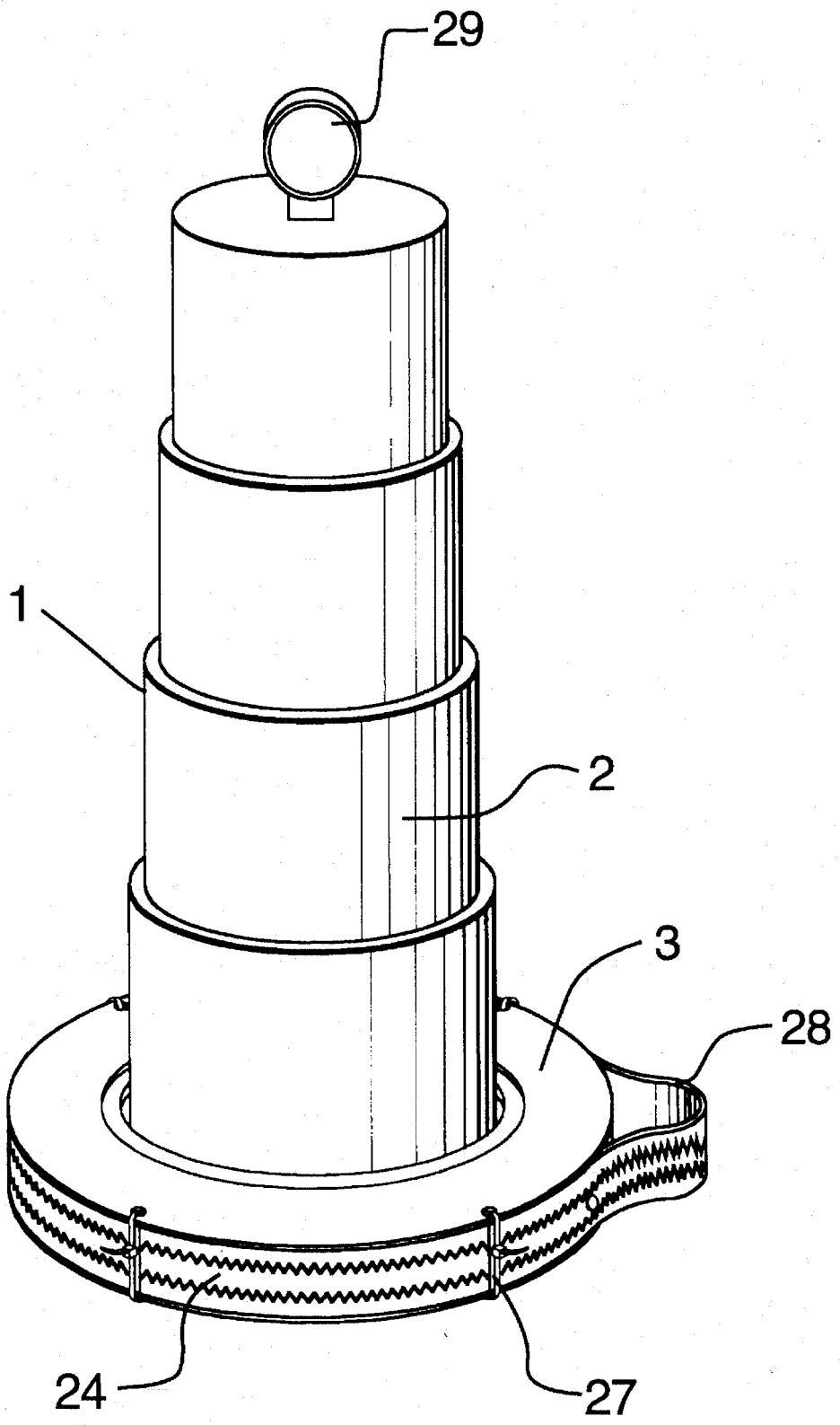
FIG. 1 is a perspective view of one embodiment of the invention.

Referring to FIG. 1, a traffic channelizing device 1 comprises a body portion 2 and a base unit 3. The body portion has a vertically tapered body 4, which can have any suitable tapered configuration ranging from a cone to a slightly tapered or stepped cylinder, oval, or polygon. The lower extremity 5 of the body portion ends in a flange 6, which rests on the ground 8. At or near the upper extremity 7 of the body portion 2, a flashing light 29 can be affixed by any suitable means, such as by permanent or temporary affixation within a recess.

The body portion 2 can be constructed of any suitable weather and impact resistance material, preferably a lightweight material such as polyethylene.

Figure 2:
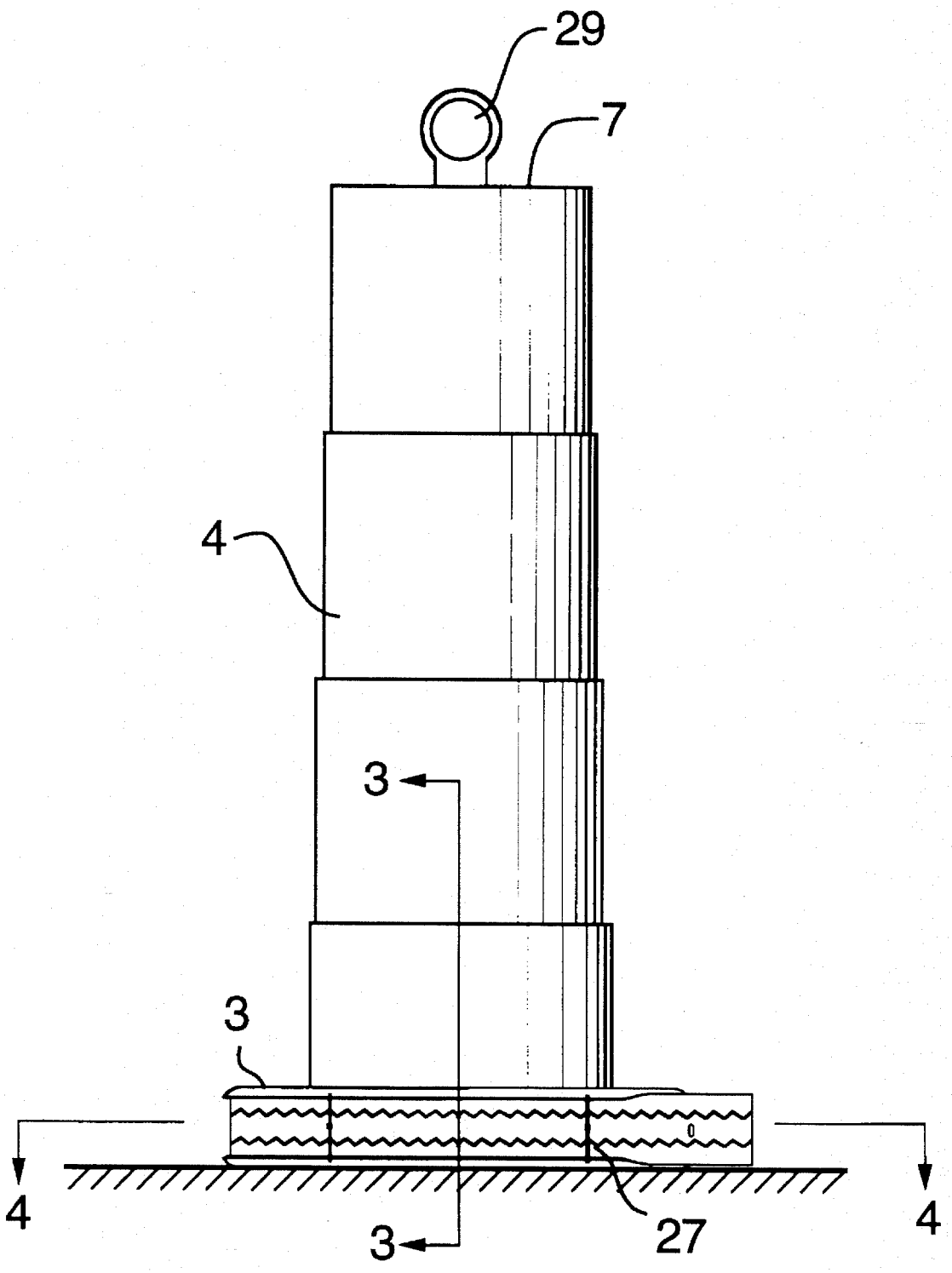
FIG. 2 is a side elevation of the embodiment shown in FIG. 1.
Figure 3:
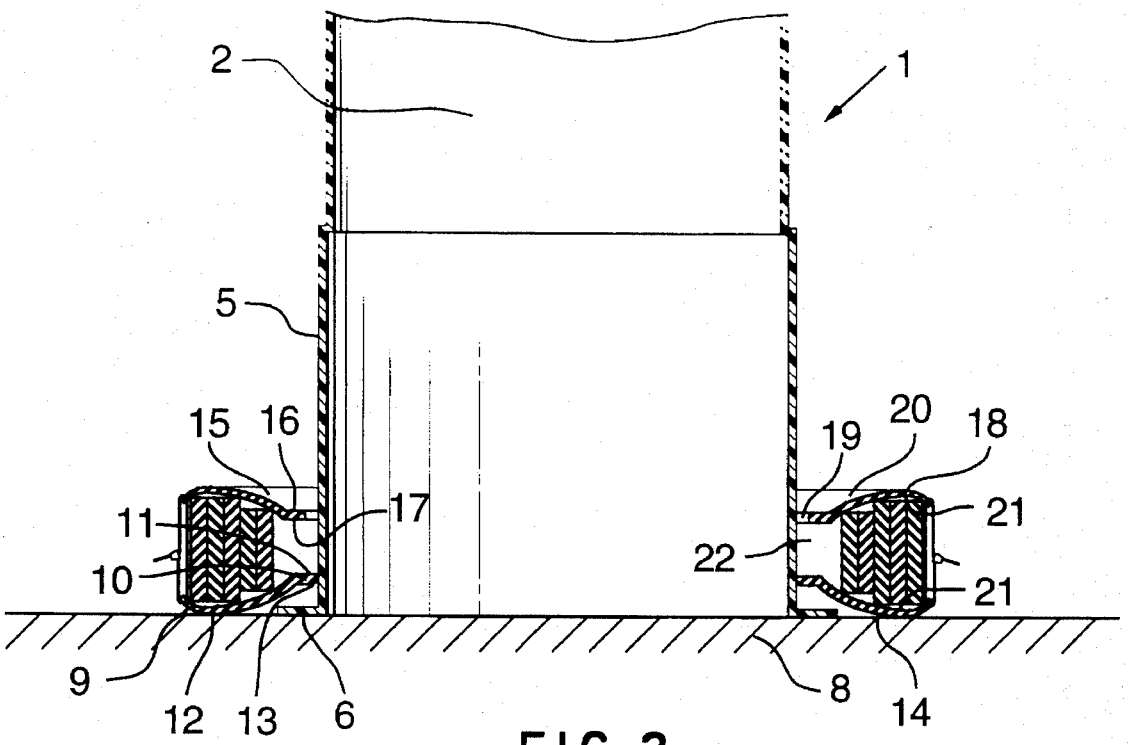
FIG. 3 is a vertical cross-section of the embodiment shown in FIG. 1.

Referring to FIGS. 2 and 3, the base unit 3 comprises a lower sidewall 9, having a planar portion 11 and a curved portion 12. The sidewall has a central hole 13 of a diameter selected for the desired fit to the lower extremity 5 of the body portion 2. The convex surface 14 of the curved portion 12 rests on the ground surface 8. An upper sidewall 15 comprises a planar portion 16 and a curved portion 18, and has a central hole 19 of a diameter selected for the desired fit at the appropriate location above the lower extremity 5 of the body portion 2. To achieve maximum stability of the device 1, the desired fit for the lower sidewall is an interference fit. However, the upper sidewall preferably has clearance to maintain the separability of the base unit 3 from the body portion 2 in the event of an impact.

The upper sidewall 15 is placed over the lower sidewall 9 so that the lower surface 17 of the planar portion of the upper sidewall faces the upper surface 11 of the planar portion of the lower sidewall, and the concave surfaces 21 of the curved portions 12 and 18 of the sidewalls face each other, forming an annular channel 22.

Figure 4:
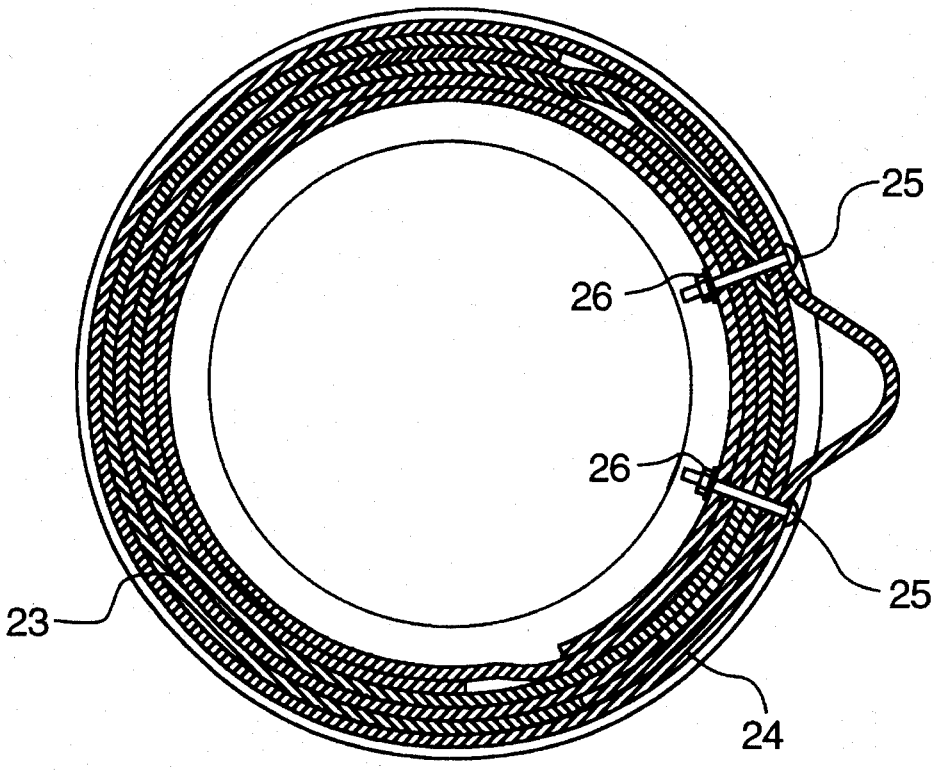
FIG. 4 is a horizontal cross-section of the base portion of the embodiment shown in FIG. 1.

Referring to FIG. 4, a tread strip 23 cut to a suitable width from at least one tire can be wound spirally within the channel to fill the space between the concave surfaces.

An outer band 24, preferably but not necessarily formed from a complete, continuous tread strip from one tire, is secured to the inner windings by a suitable means such as bolts 25 and nuts 26. The outer band inherently has a larger circumference than that of the penultimate winding, by virtue of being positioned radially inwardly from its original location in an intact tire, so that there is sufficient excess length to form a protruding loop 28. The fastening means are attached so that the excess length of the outer band forms the loop 28, which acts as an important safety feature by inhibiting rolling if the device is overturned when in use. In addition, the loop has the practical advantage of facilitating carrying, or of the removal of one or more devices from a stack. As a further embodiment, the outer band can be secured so as to form more than one protruding loop.

Additional upper sidewalls (not shown) can be added above the upper sidewall 15 where for situations where extra weight is needed. Such additional sidewalls are disposed in the same direction as the upper sidewall 15.

For increased stability, as shown in FIGS. 1 and 2, the upper surface 20 of the upper sidewall can be attached by any suitable securing means such as clips 27 to a suitable location on the curved portion 12 of the lower sidewall. The wound tread strips can also be affixed to any suitable location on either sidewall by any appropriate securing means (not shown).

The sidewalls can be selected from any suitable size of tires; used tires from cars are particularly advantageous as to size and weight. It has been found that the desired fit and clearance for the sidewalls is readily obtained for a commonly used size of body portion by the use of the sizes R 15 for the lower sidewall 9 and R 16 for the upper sidewall 15. However, the same size tire sidewalls can be used for the lower and upper parts if desired.

In addition to the advantages which are described or apparent from the above, it should be mentioned that the structure of the invention provides increased rigidity across the entire base, which significantly increases the resistance to overturning. The center of gravity of the overall unit is also lower, and the weight is more distributed across the base, which further enhances stability.

What is claimed as the invention is:

1. A base unit for use in association with a body portion of a traffic channelizing device, said base unit having a substantially circular lower base portion comprising a sidewall of a vehicle tire, said sidewall having an inner planar section and an integral outer curved section providing a substantially circumferential convex ground contacting surface, and a substantially circular upper base portion comprising a separate independent sidewall of a vehicle tire, said sidewall of said upper base portion having an inner planar section and an integral outer curved section, disposed to form an annular concave channel between said upper and lower base portions, and ballast means affixed within said annular channel.

2. A base unit as claimed in claim 1 wherein said upper and lower base portions have a central opening of unequal diameter.

3. A base unit as claimed in claim 1 wherein said ballast means comprises at least one tread portion of a least one vehicle tire.

4. A base unit as claimed in claim 3 wherein said at least one tread portion is wound in a spiral configuration and is secured as an integral unit by a securing means.

5. A base unit as claimed in claim 4 wherein said ballast means is affixed to at least one location within said annular channel means by a securing means.

6. A base unit as claimed in claim 4 wherein said ballast means further comprises an outer tread portion affixed to comprise at least one protruding loop portion.

7. A base unit as claimed in claim 6 wherein said upper and lower base portions have a central opening of unequal diameter.

8. A traffic channelizing device comprising a base unit and a separate body portion extending upwardly therefrom, said base unit comprising a substantially circular lower base portion comprising a sidewall of a vehicle tire, said sidewall having an inner planar section and an integral outer curved section providing a substantially circumferential convex ground contacting surface, and a substantially circular upper base portion comprising a separate independent sidewall of a vehicle tire, said sidewall of said upper base portion having an inner planar section and an integral outer curved section, disposed to form an annular concave channel between said upper and lower base portions, and ballast means affixed within said annular channel said body protion having a generally cylindrical portion extending upwardly from an integral outwardly projecting circumferential ground-engaging flange.

9. A traffic channelizing device as claimed in claim 8, wherein a central hole in said upper base portion provides substantial clearance around an adjacent wall of said body portion, and a central hole in said lower base portion forms an interference fit with lower extremity of said body portion at a predetermined location.

* * * * *